US005179306A

United States Patent [19]

Nasar

[11] Patent Number: 5,179,306

[45] Date of Patent: Jan. 12, 1993

[54] SMALL DIAMETER BRUSHLESS DIRECT CURRENT LINEAR MOTOR AND METHOD OF USING SAME

[75] Inventor: Syed A. Nasar, Lexington, Ky.

[73] Assignee: Escue Research and Development Company, El Cajon, Calif.

[21] Appl. No.: 751,977

[22] Filed: Aug. 29, 1991

Related U.S. Application Data

[60] Continuation-in-part of Ser. No. 611,186, Nov. 9, 1990, which is a division of Ser. No. 462,833, Jan. 10, 1990, Pat. No. 5,049,046.

[51] Int. Cl.[5] ..... H02K 41/02

[52] U.S. Cl. ..... 310/14; 310/12; 310/23

[58] Field of Search ..... 310/12, 14, 112, 198, 310/209, 30, 23; 335/266, 268

[56] References Cited

U.S. PATENT DOCUMENTS

| | | | |
|---|---|---|---|
| 4,210,831 | 7/1980 | Hurst | 310/13 |
| 4,215,283 | 7/1980 | Hinds | 310/14 |
| 4,508,984 | 4/1985 | Guedj et al. | 310/14 |
| 4,810,914 | 3/1989 | Kardis et al. | 310/12 |
| 5,049,046 | 9/1991 | Escue et al. | 417/411 |

*Primary Examiner*—Steven L. Stephan
*Assistant Examiner*—Judson H. Jones
*Attorney, Agent, or Firm*—Bernard L. Kleinke; Jerry R. Potts; William Patrick Waters

[57] ABSTRACT

A new and improved linear motor and method of using it for producing a sufficient reciprocating thrusting action to enable well fluids be pumped through the production tubing of a well to the ground surface. The linear motor includes a mover and a stator, said stator including a set of coils for producing a series of electromagnetic field extending at least partially in an axial direction when energized with an electric current and a stator core defining a plurality of spaced-apart transversely disposed coil receiving slots and an annular axially extending mover receiving bore. The mover includes an elongated member mounted telescopically reciprocatively within the mover receiving bore and a plurality of permanent magnets interleaved with low reluctance spacers for helping to reduce core flux density in order to improve overall motor performance.

21 Claims, 12 Drawing Sheets

Fig. 4
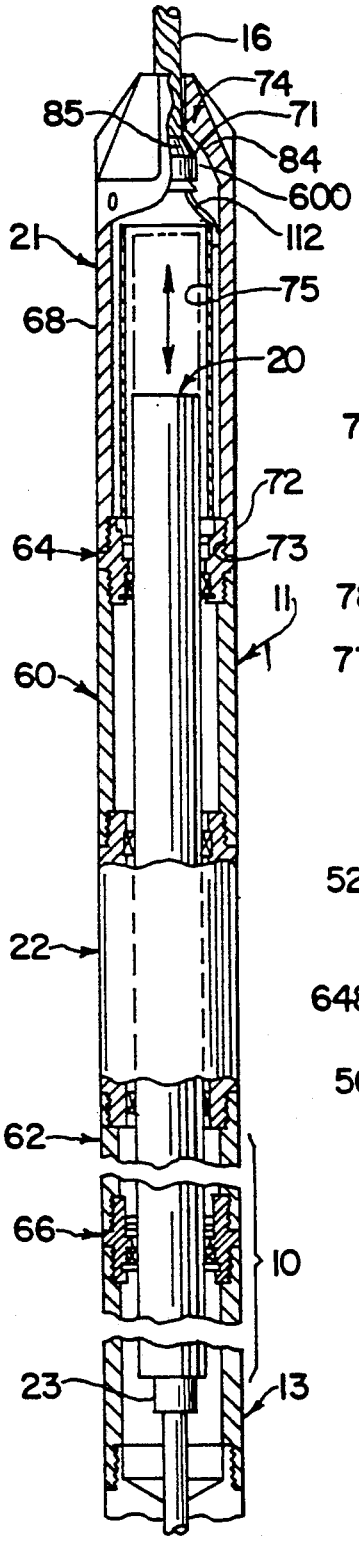
Fig. 5
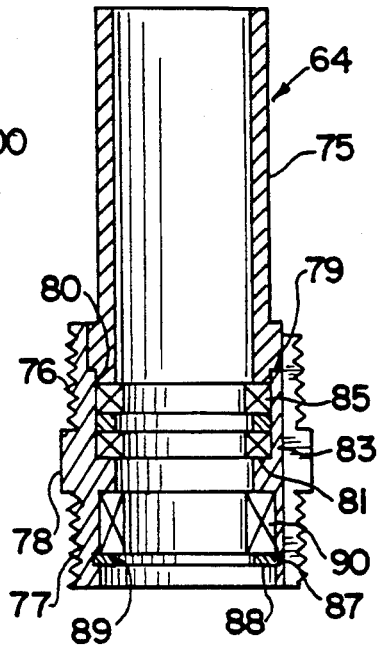
Fig. 7
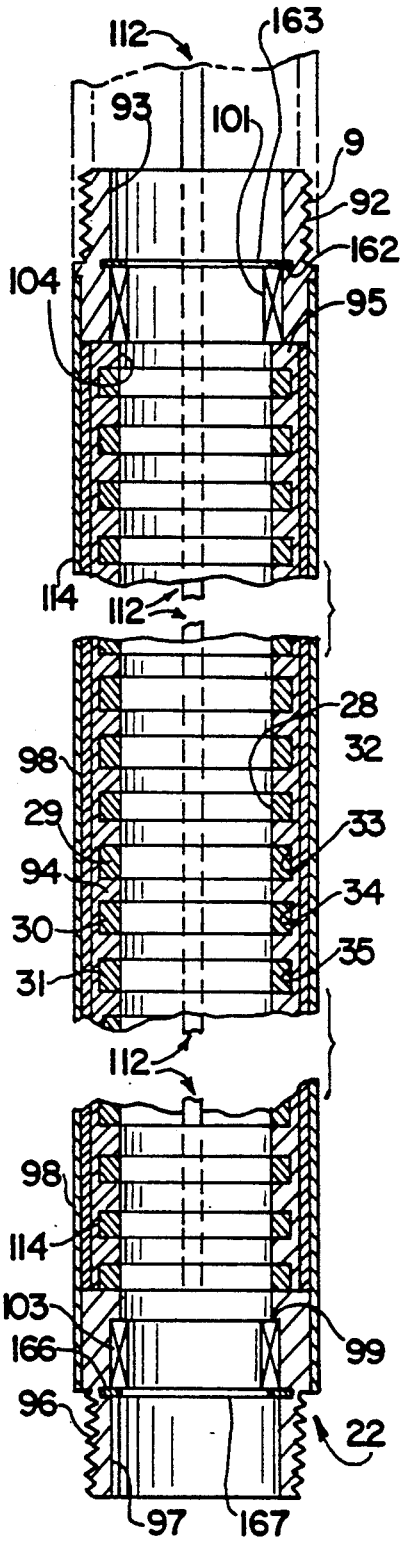
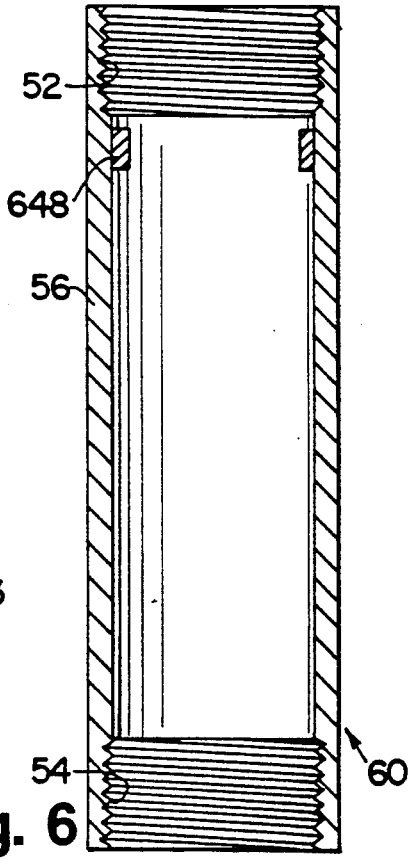
Fig. 6

SMALL DIAMETER BRUSHLESS DIRECT CURRENT LINEAR MOTOR AND METHOD OF USING SAME

CROSS-REFERENCE TO RELATED APPLICATIONS

This is a continuation-in-part of U.S. patent application Ser. No. 07/611,186 filed Nov. 9, 1990, entitled "PUMP CONTROL SYSTEM FOR A DOWNHOLE MOTOR-PUMP ASSEMBLY AND METHOD OF USING SAME," which is a divisional of U.S. patent application Ser. No. 07/462,833 filed Jan. 10, 1990, entitled "PUMP CONTROL SYSTEM FOR A DOWNHOLE MOTOR-PUMP ASSEMBLY AND METHOD OF USING SAME" now U.S. Pat. No. 5,049,046.

TECHNICAL FIELD

The present invention relates, in general to a linear motor and method of using such a motor downhole in a well, and it more particularly relates to a small diameter linear motor for operating a pump downhole in an oil well.

BACKGROUND ART

With the advent of the industrial age and the need for inexpensive and readily available fuels, there has been an ever increasing demand upon the oil reservoirs of the world. Such demand has depleted the more easily accessed oil reservoirs and created a need for more cost-effective and efficient methods of recovering well fluids from low production wells.

Accordingly, several potential solutions have been proposed for not only reducing the cost for manufacturing and installing downhole fluid removing equipment, but also for reducing the daily operating cost and maintenance cost of such equipment once installed.

One attempt at improving the cost effectiveness of recovering fluids from low production wells was the utilization of a downhole motor-pump assembly employing a linear motor coupled to a ground surface power source and motor controller by an electrical conduit. While such a solution was satisfactory for some applications, such an arrangement proved to be too expensive in installing and removing such assemblies for repair purposes as the depth of modern wells was extended.

Another attempt at improving cost and efficiency factors in low production wells is disclosed in the above-mentioned patent application Ser. No. 07/462,833, now U.S. Pat. No. 5,049,046. In that patent In that application, there is disclosed, a motor-pump assembly suspended by a cable for coupling power and control signals downhole and for introducing and removing a motor-pump assembly from the well via the production tubing of the well. Such a motor-pump assembly is a highly desirable approach for many low producing wells. While such an assembly and system is desirable it would be highly desirable to have a pump and motor assembly which is easier to transport and to install. In this regard, because of the physical constraints of requiring the motor-pump assembly to be mounted within a production tube having a very small diameter such as approximately two inches, it has proven difficult, if not impossible, to substantially decrease the overall length of such a motor pump assembly while still maintaining its efficiency and thrust or drive producing forces.

For example, while it may be theoretically possible to have a small diameter linear motor that produces a certain drive force, such as a 500 lb. thrust, such a motor would be so long (in excess of 50 feet in length) that it would be unwieldy due to its excessive length. In this regard, such a motor could not be easily and readily transported from a manufacturing site to a well site by conventional and relatively inexpensive transportation. Moreover, because of its unwieldy length the motor-pump assembly would be difficult to mount in the production tube at the well site.

Therefore it would be highly desirable to have a new and improved linear motor which would produce a sufficient amount of thrust to efficiently remove well fluid from a deep well in a cost efficient manner and which could be easily and installed at transported by conventional transportation a well site in a relatively inexpensive manner.

DISCLOSURE OF INVENTION

Therefore, it is the principal object of the present invention to provide a new and improved linear motor and method that helps reduce losses in order to improve the overall efficiency of the motor for removing well fluids from a deep well in a cost efficient manner.

Another object of the present invention is to provide such a new and improved linear motor that can be easily transported by conventional transportation and installed at a well site in a relatively inexpensive manner.

Still yet another object of the present invention is to provide a new and improved control system for use with the linear motor and a method of using the same for producing a highly efficient reciprocating action for well fluid pumping purposes.

Briefly, the above and further objects of the present invention are realized by providing a new and improved linear motor and method of using it with a control system for downhole use, for producing a sufficient reciprocating thrusting action to let well fluids be pumped through the production tubing of the well to the ground surface. The linear motor includes a laminated stator having a very small transverse thickness to axial length ratio. The stator includes an annularly-shaped hollow core defining a plurality of transversely extending spaced-apart coil receiving slot and a set of coils individually mounted in said slots for producing a series of electromagnetic fields extending at least partially in an axial direction when energized electrically. The linear motor also includes an elongated rod with a series of permanent magnets interleaved with low reluctance spacers mounted thereon for helping to reduce core flux density in order to improve overall motor performance.

The system includes a surface motor control unit and a motor-pump cartridge unit having the motor, a downhole motor control unit, that cooperates with the surface motor control unit to supply electrical pulses to the motor, and a downhole pump unit coupled to the motor for pumping fluids from a well. The cartridge unit is supported in a downhole cartridge sleeve assembly attached to the terminal end of the production tubing disposed within the well. The sleeve assembly helps maintain the cartridge unit in a stationary position for fluid pumping purposes. The motor-pump cartridge unit may be raised or lowered by a control cable disposed within the production tubing for helping to facilitate the repair or replacement of the motor and/or pump unit.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein:

FIG. 4 is a reduced cross sectional view of a linear d.c. motor assembly taken substantially on line 4—4 of FIG. 2, which is constructed in accordance with the following invention;

FIG. 5 is a cross sectional view of a cable housing unit forming part of the linear d.c. motor assembly of FIG. 4;

FIG. 6 is a cross sectional view of a housing section of the linear d.c. motor assembly of FIG. 4;

FIG. 7 is a cross sectional view of the stator forming part of the linear d.c. motor assembly of FIG. 4;

BEST MODE FOR CARRYING OUT THE INVENTION

Figure 1:
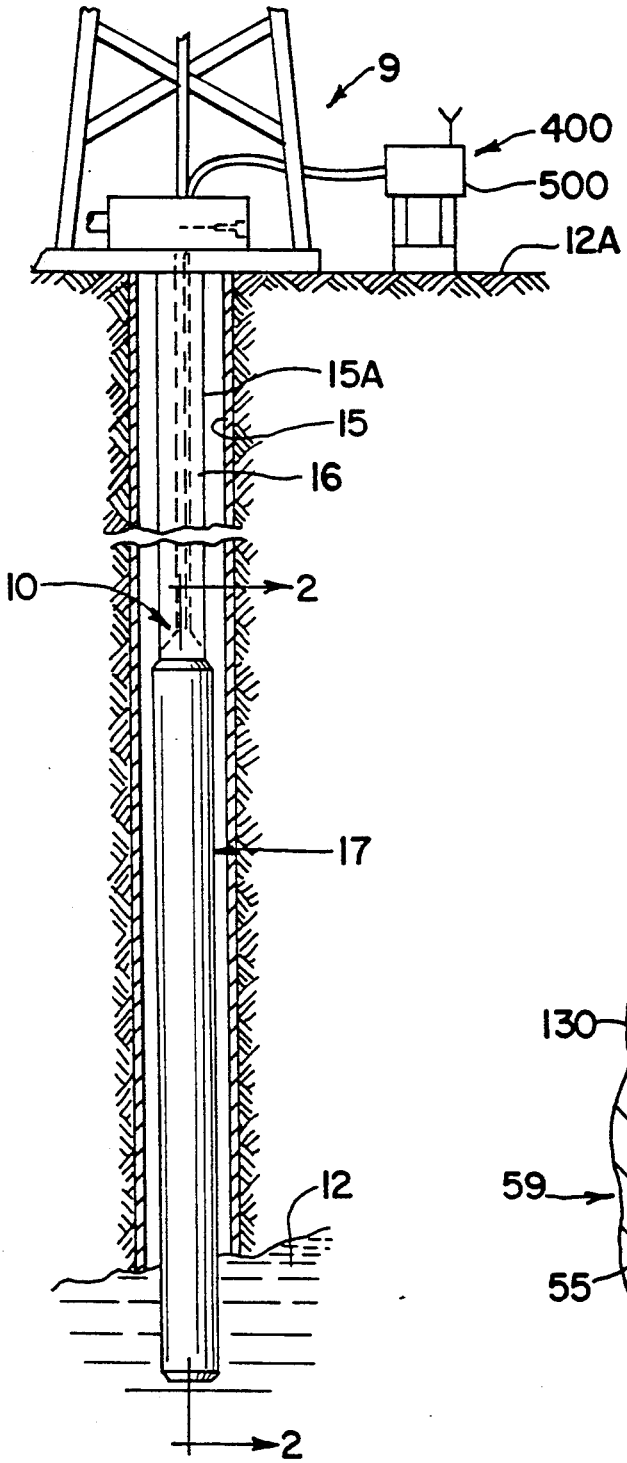
FIG. 1 is a sectional view of a well containing a linear d.c. motor which is constructed in accordance with the present invention and which is shown disposed in a motor-pump cartridge unit assembly for illustrative purposes.
Figure 2:
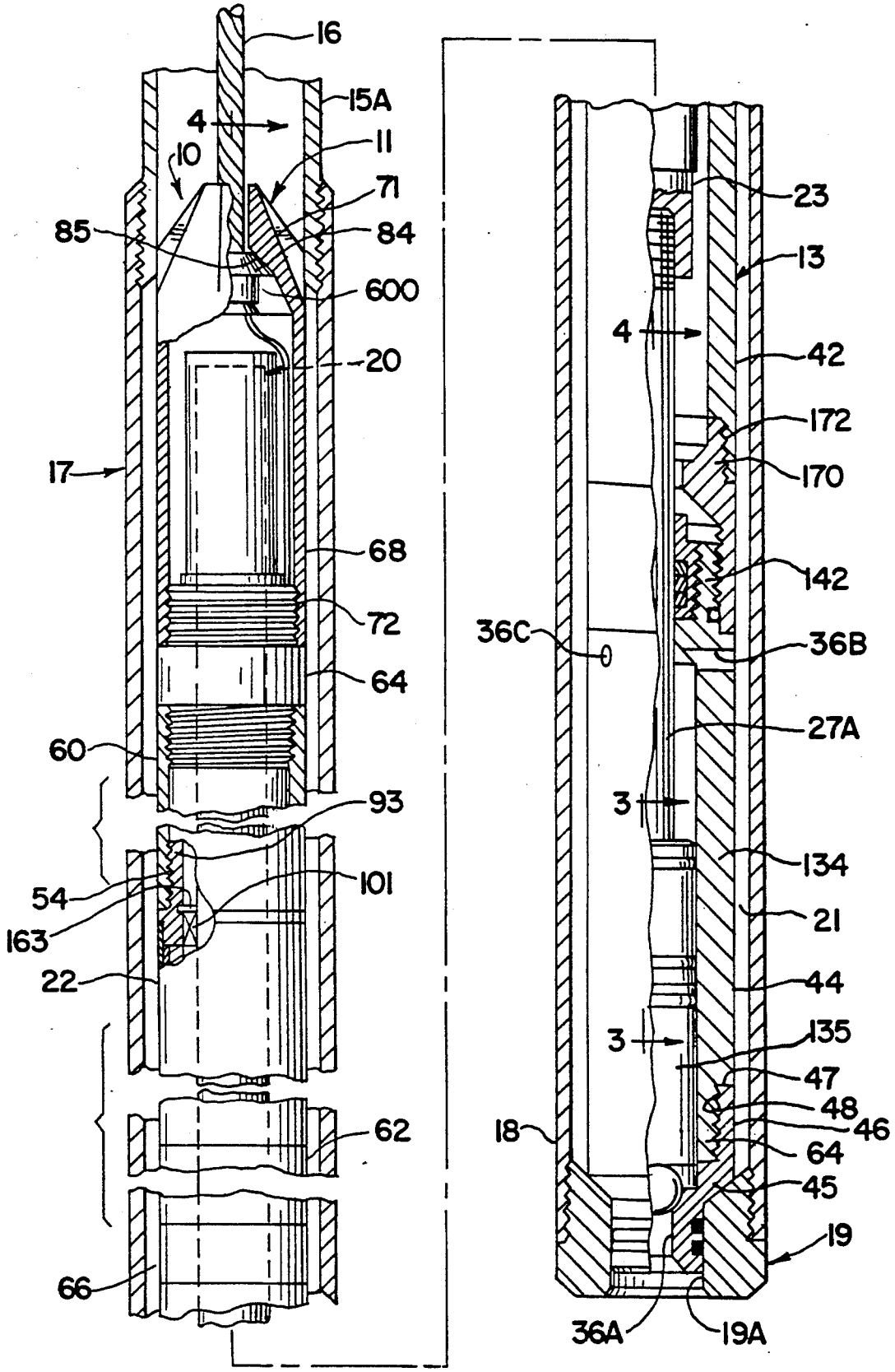
FIG. 2 is a greatly enlarged partially cut away cross sectional view of the motor-pump cartridge unit disposed within the production tubing of the well of FIG. 1, taken substantially on line 2—2.

Referring now to the drawings, and more particularly to FIGS. 1, 2 and 4 thereof, there is shown a pump control system 9 for use with a motor pump cartridge unit or assembly 10 including a sucker rod pump 13 (FIG. 2) and a downhole brushless linear direct current motor assembly 11, (FIG. 4) which is constructed in accordance with the present invention. The linear direct current motor assembly 11 is a nonsalient pole synchronous machine with a large magnetic air gap and is shown in FIG. 2 in an operative downhole position for driving the sucker rod pump 13 reciprocatively to pump well fluids, such as the fluids 12, from downhole to the surface 12A. The linear motor assembly 11 is electrically connected to a motor controller 400 for controlling the motor current levels to provide hysteresis control. The linear direct current motor assembly 11 and the sucker rod pump 13 are mechanically coupled together to form the motor-pump cartridge unit 10 for pumping well fluids 12 from a conventional oil well.

Figure 8:
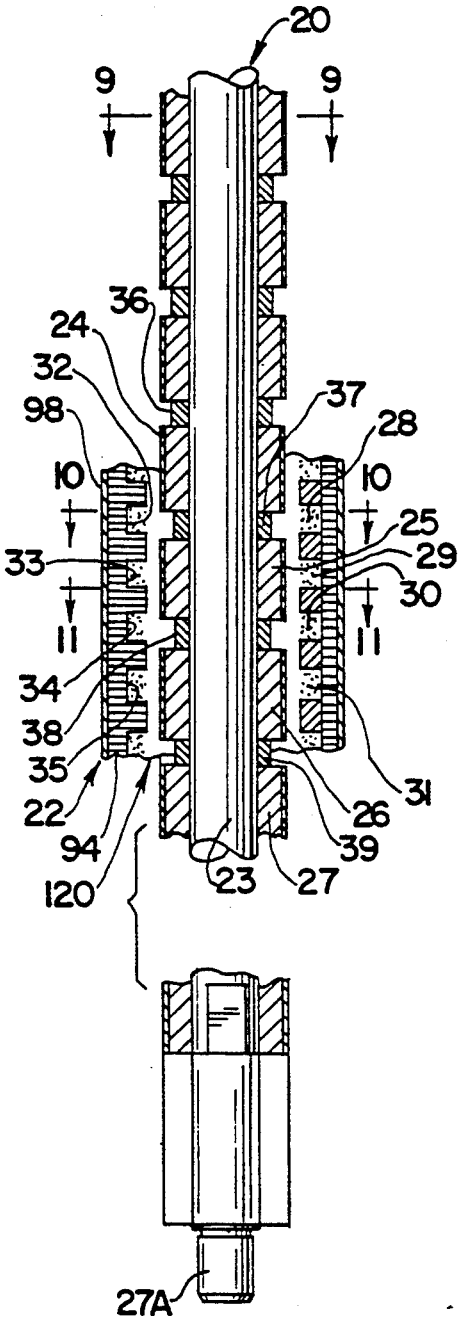
FIG. 8 is an enlarged partially fragmentary view of the mover and stator forming part of the linear d.c. motor assembly of FIG. 2.
Figure 9:
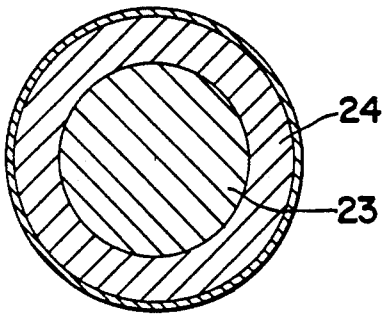
FIG. 9 is a transverse cross sectional view of the mover of FIG. 8 taken substantially along lines 9—9.

As will be explained hereinafter in greater detail, the motor assembly 11 includes a mover or actuator 20 (FIGS. 2 and 8), a motor housing 21 (FIG. 4) and a cylindrically shaped hollow body stator 22 (FIGS. 7 AND 8). The mover 20 coacts electromagnetically with the stator 22 causing the mover 20 to travel reciprocatively rectilinearly within the hollow interiors of the housing 21 and the stator 22 as the stator 22 is electrically energized by the controller 400.

Figure 12:
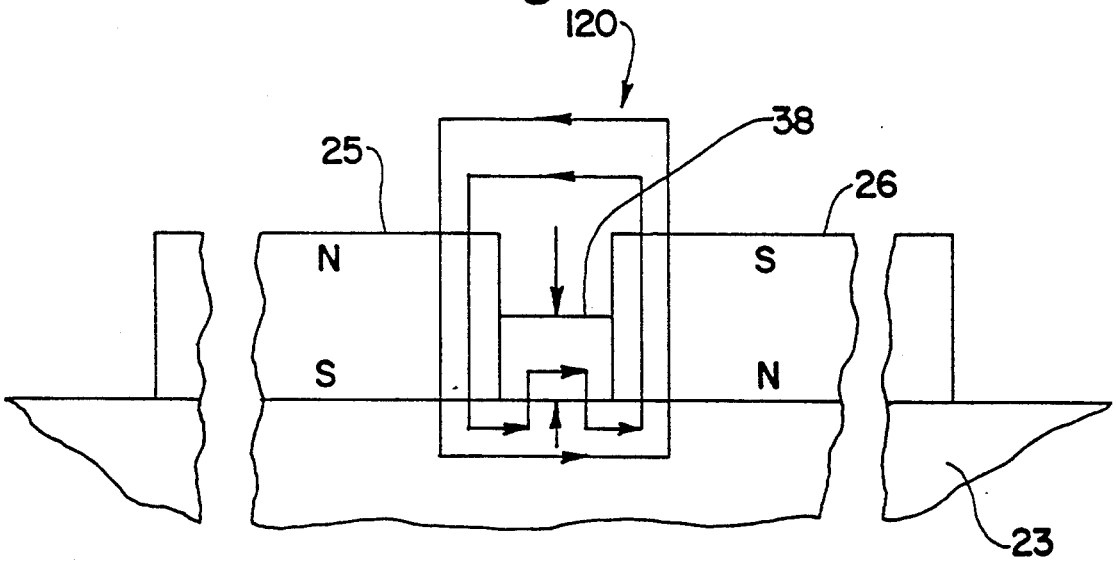
FIG. 12 is a greatly enlarged diagrammatic fragmentary view of a spacer forming part of the mover of FIG. 8, illustrating the path of the magnetic flux lines passing through the spacer.

As best seen in FIG. 8, the mover 20 is slidably mounted within the stator 22 and includes a series of spaced apart annularly shaped magnets, such as magnets 24, 25, 26 and 27 mounted along the longitudinal axis of a rod or shaft 23. The magnets mounted on the shaft 23 are spaced apart from one another by a set of annular iron shunting rings or spacers, such as spacers 36–39. The spacers are interleaved with the magnets in order to help reduce core flux density and thus, improve motor performance. In this regard, as best seen in FIG. 12, the spacers such as spacer 38 cause magnetic flux shown generally at 120, produced by the magnets, such as the magnets 25 and 26, to take a bypass or alternate path through the spacers thus reducing the amount of magnetic flux entering the stator core.

Also in order to help to reduce substantial coil reaction fields, the thickness of the individual spacers is substantially less than the thickness of the individual magnets. In this regard, the thickness of the individual magnets and spacers is determined by the speed of the motor, and more particularly to help establish a desired pole pitch between two consecutive magnets.

Figure 21:
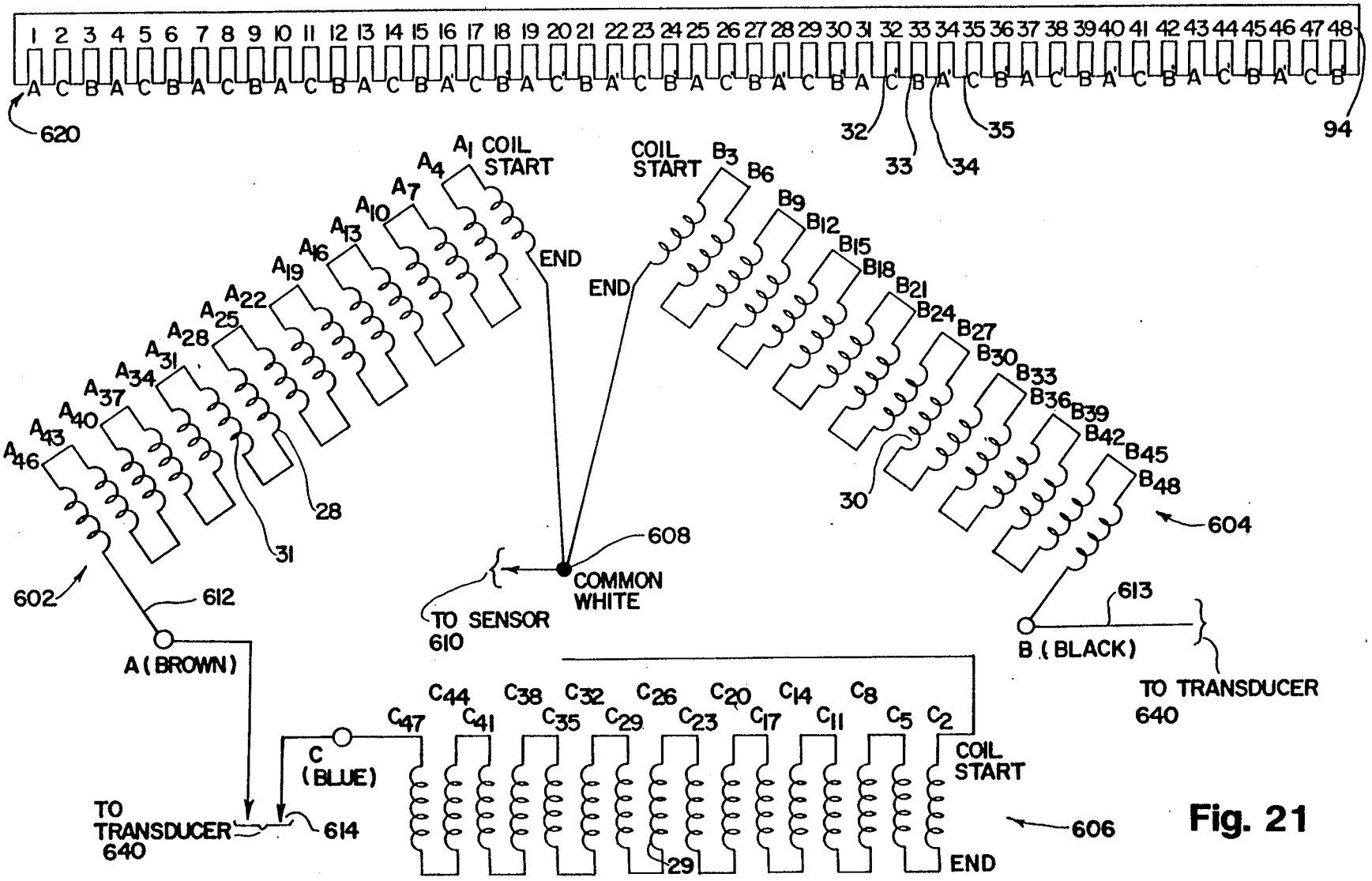
FIG. 21 is a partial diagrammatic and schematic representation of the stator coil winding phase groups and their locations relative to the stator core of FIG. 7.

As best seen in FIG. 7, the stator 22 includes a laminated core 94 with an internal bore 104 having a sufficient diameter to permit the unimpeded reciprocative movement of the mover 20 within the stator 22. The stator 22 also includes a set of stacked equally distantly spaced apart annularly shaped three phase electromagnetic stator coils or windings, such as coils 28, 29, 30 and 31 (FIG. 8). The ring-shaped coils are mounted in a set of open slots in the stator core 94 such as the slots 32–35 (FIGS. 7 and 8), in order to maximally utilize the iron and copper volume in the stator 22. The coils in the stator core, coact electromagnetically with the permanent magnets mounted on the mover 20 to cause the mover 20 to move reciprocatively rectilinearly within the motor housing 21 and the stator 22. In this regard, when the coils are electrically energized with an electrical current by the motor controller 400, a set of magnetic fields are established to induce motional voltages in the three phase stator windings and in the stator core 94. FIG. 21 is a partial diagrammatic and schematic representation of the stator core 94 and the windings arranged in a set of phase groups 602, 604 and 606 relative to their slot locations such as $A_1$, $B_3$ and $C_2$ for example, in the stator core 94.

Figure 18:
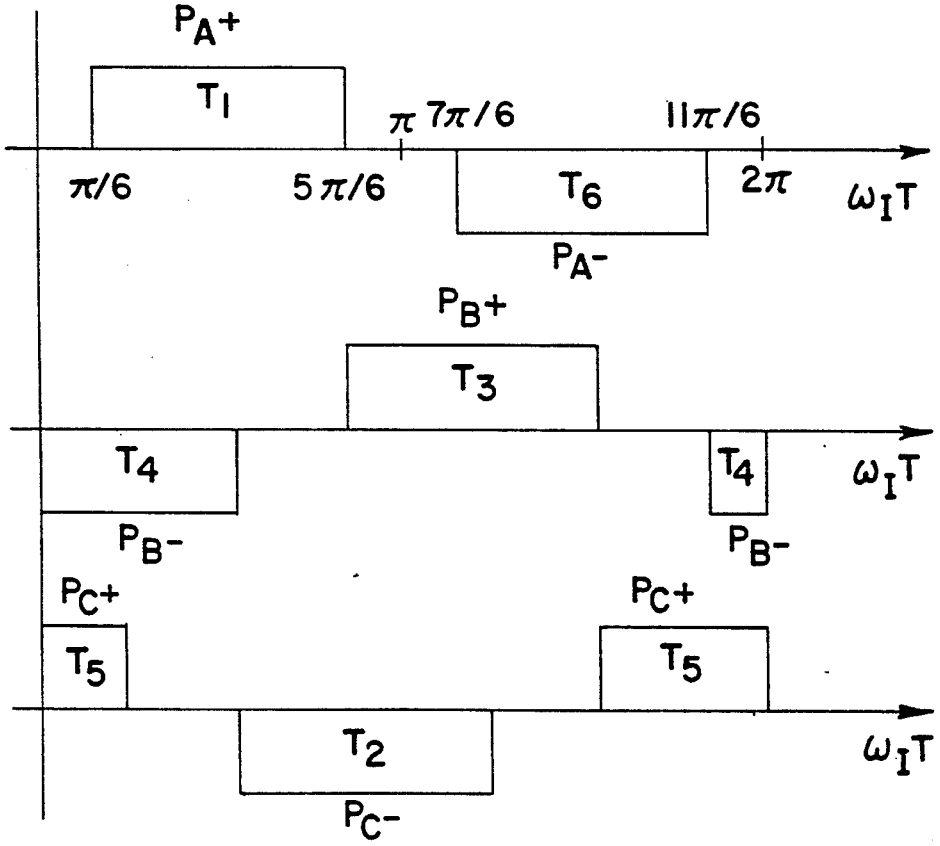
FIG. 18 is a phase diagram illustrating the on-off states of the transducer transistors of FIG. 16 for forward motion of the mover.
Figure 19:
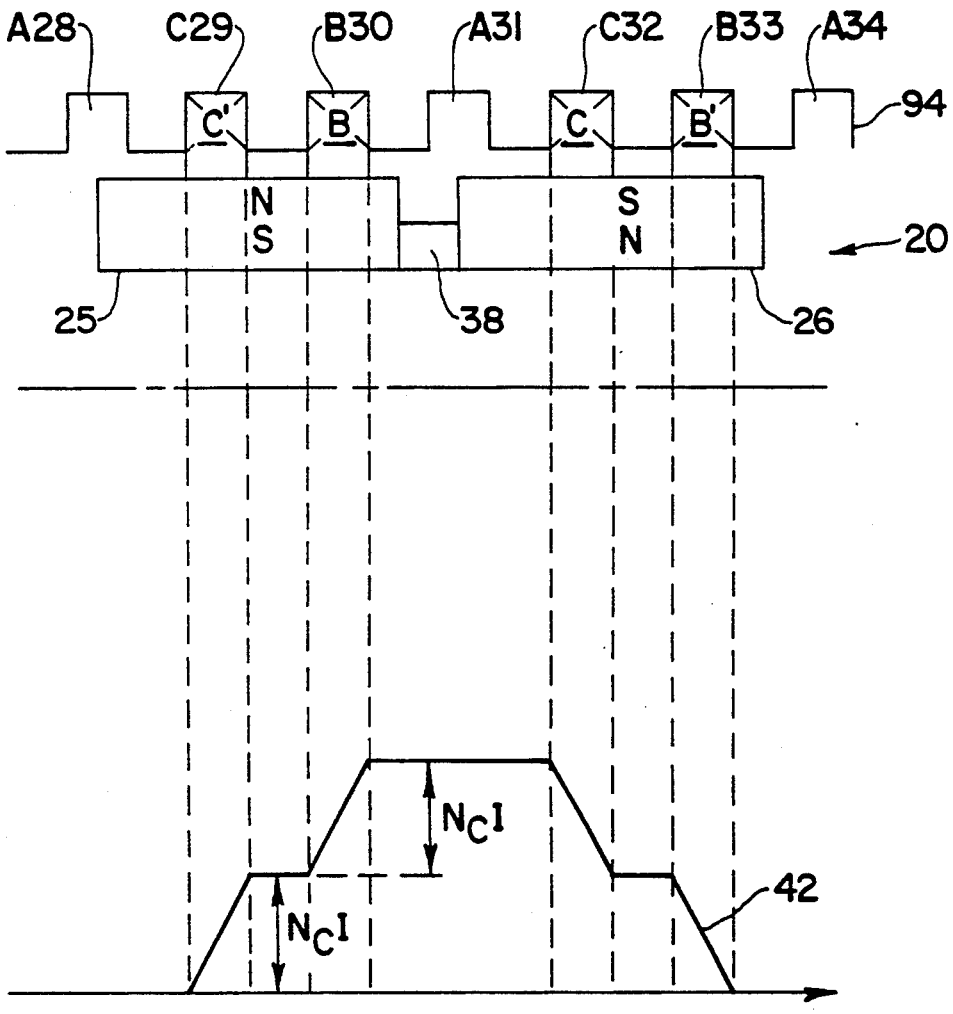
FIG. 19 is a mmf diagram illustrating phase b and c conduction in the motor assembly of FIG. 1.

In operation, the controller 400 sends generally rectangular phase pulses of electric current (FIG. 18) to the stator coils, such as the coils 28–31, causing the coils to be magnetized with alternate north and south poles. Reversing the current, as shown in FIG. 18, reverses the sequence of the poles. Thus, when the fields produced in the coils 28–31 cause their poles to be out of alignment with the poles on the actuator 20, the actuator 20 under the influence of magneto motive forces (mmf) moves to position the poles so they oppose each other. The motor controller 400 causes the current sent to the coils 28–31 to be reversed to change the poles so that actuator 20 moves to follow them. FIG. 19 is a diagrammatic illustration showing the magneto motive forces, shown generally at 42, induces in two phase conduction, as the phase current pulses energize coils 29–30 and 32–33 respectively for co-acting with magnets 25 and 26.

In order to permit the transportation of the well fluids 12 to the surface 12A, the oil well includes a casing 15 having a set of interconnected production tubes or tubings 15A disposed therein. As best seen in FIGS. 1 and 2, the production tubing 15A terminates downhole in a downhole cartridge sleeve assembly 17 having a containment tube 18 adapted to be coupled to the production tube 15A for directing well fluids therein and a sealing seat 19 (FIG. 2) which is adapted to receive and support the motor-pump cartridge unit 10 in a stationary downhole position within the hollow interior of the tube 18 for fluid pumping purposes. In this regard, the sealing seat 19 includes a centrally disposed hole or opening 19A that permits well fluids 12 to enter the motor-pump cartridge unit 10 for pumping the well fluids 12 to the surface 12A. A control cable 16 attached to above ground means (not shown) is disposed within the hollow interior of the producing tubing 15A and is attachable to one end of the motor-pump cartridge unit 10 for the purpose of permitting the unit 10 to be raised or lowered within the tubing 15A to help facilitate the repair or replacement of either the linear motor assembly 11 or the sucker rod pump 13. The pump control system 9 and sleeve assembly 17 are more fully described in copending U.S. patent application Ser. No. 07/462,833 mentioned above.

In operation, the motor pump cartridge unit 10 is lowered by the control cable 16 into the oil well through the production tubing 15A. The cartridge unit 10 is received within the cartridge sleeve assembly 17 which secures removably the cartridge unit 17 within the centrally disposed sealing seat 19. In this regard, when the cartridge unit 10 is received within the interior of the cartridge sleeve assembly 17, the seat 19 matingly engages and supports the cartridge unit 10. In this regard, a substantially fluid tight seal is formed between the cartridge unit 10 and the seat 19 of the cartridge sleeve assembly 17, with the cooperation of the static head of the fluid 12 within the production tubing 15A. Power is then applied to the motor assembly 11 via the control cable 16 to initiate a fluid pumping action. In this regard, the seat 19 serves as a fulcrum so that fluids in the well may be discharged from the motor pump cartridge unit 10 into the containment tube 18 and thence upwardly into the production tubing 15A for transportation to the surface 12A.

Considering now the motor controller 400, in greater detail with reference to FIGS. 1 and 4, the motor controller 400 is electrically connected to the stator 22 for sending electric current to the electromagnetic coils mounted therein for controlling the motor current levels to provide hysteresis control. The motor controller 400 includes a surface motor pulse control assembly 500 and a downhole motor control electronic unit 600 (FIG. 2) for controlling the operation of the downhole motor pump cartridge unit 10. The surface motor pulse control assembly 500 is interconnected to the downhole motor control unit 600 by the cable 16. The control unit 600 is interconnected to the stator windings or coils through a conductor cable shown generally at 112 (FIGS. 7, 10 and 12).

Figure 15:
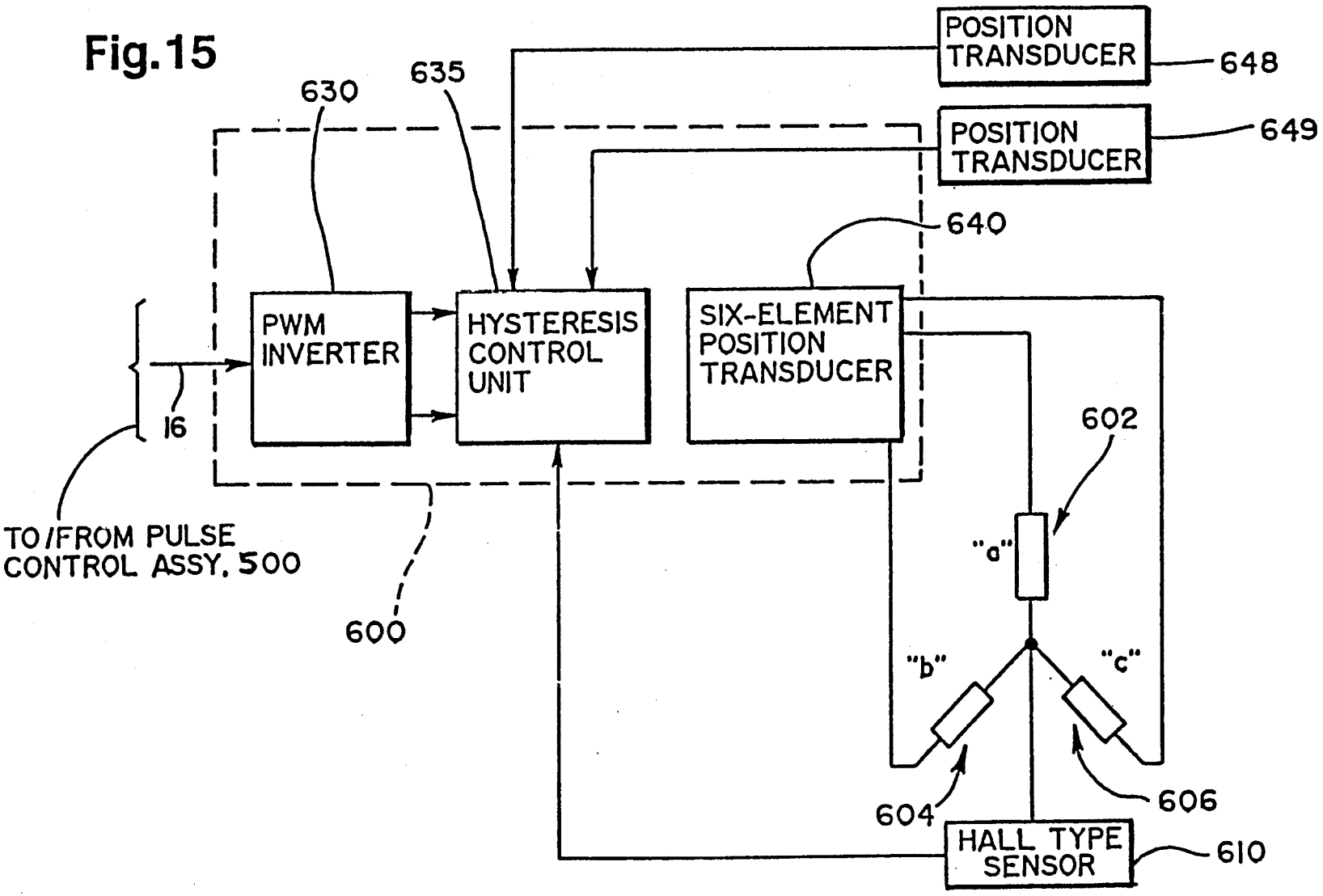
FIG. 15 is a block diagram of a motor control unit of FIG. 1.

As will be explained hereinafter in greater detail, the stator coils are arranged in phase groupings shown generally at 602, 604 and 606 (FIG. 21). The phase groupings 602, 604 and 606 are interconnected at one of their terminal ends through a common node connector 608 which in turn is coupled to the motor control unit 600 through a Hall type sensor 610 (FIG. 15). The sensor 610 is a six elements per pole pair position sensor. The other terminal ends of the phase groupings 602, 604 and 606 are individually connected to the motor control unit 600 via the conductor cable 112 through conductors 612–614 respectively.

In order to provide a passageway for the cable 112 between the motor control unit 600 and the stator coil groupings 602, 604 and 606, the stator core 94 includes a groove or slot 110 (FIGS. 10 and 11) that permits the passage of the cable connectors 612–614 as well as other control wires.

Figure 10:
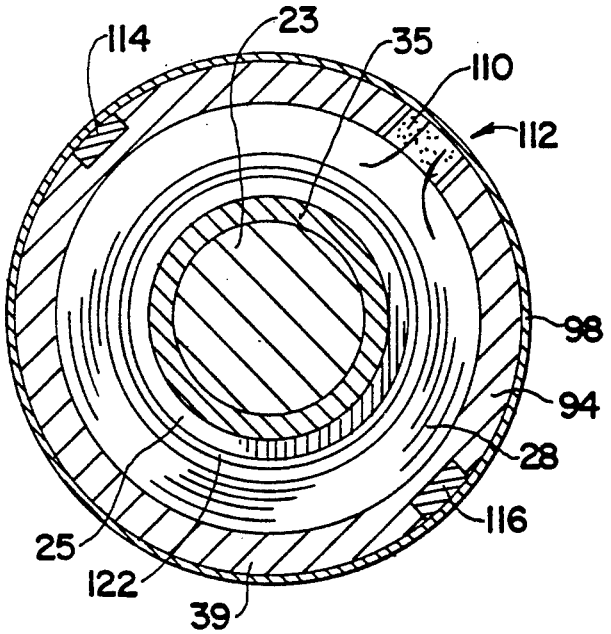
FIG. 10 is a transverse cross sectional view of the stator and mover of FIG. 8 taken substantially along lines 10—10.
Figure 11:
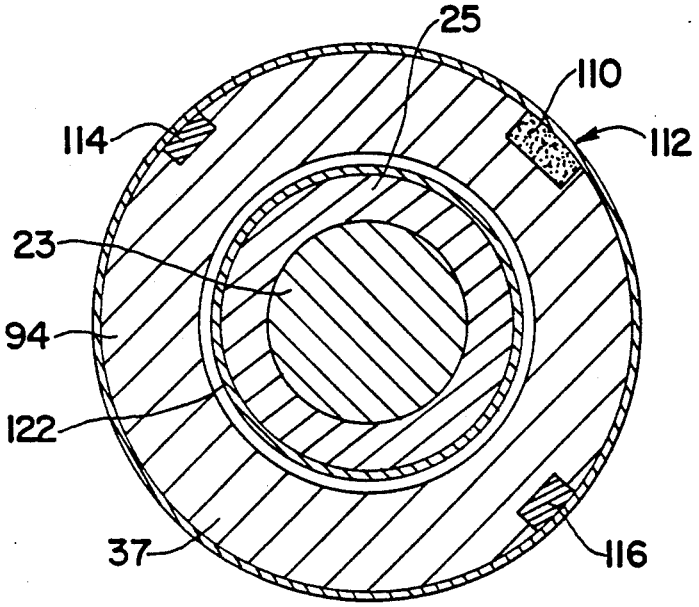
FIG. 11 is a transverse cross sectional view of the stator and mover of FIG. 8 taken substantially along lines 11—11.
Figure 13:
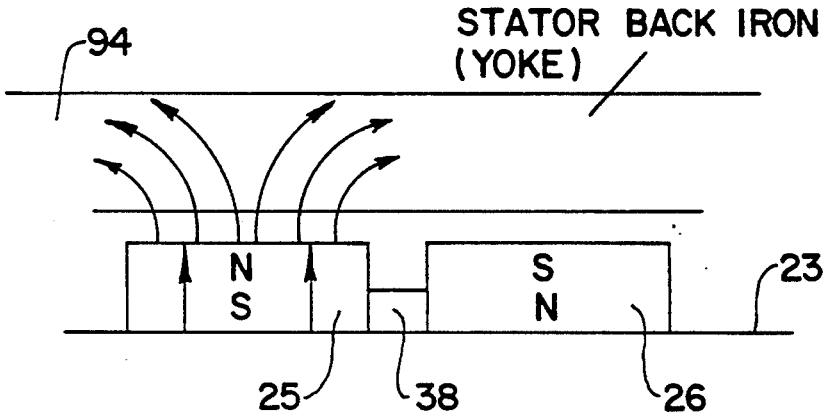
FIG. 13 is a diagrammatic view of the stator core of FIG. 8 illustrating the black iron core flux lines over the length of a mover magnet.
Figure 14:
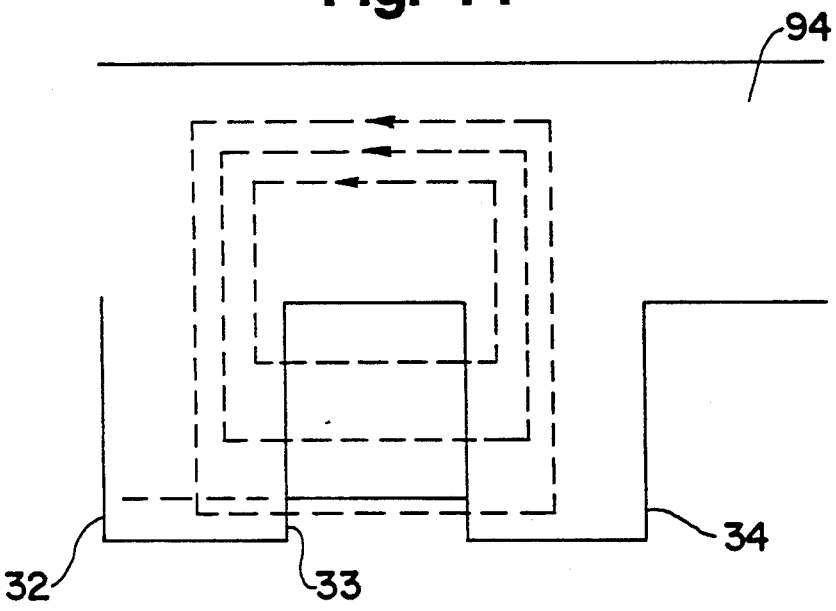
FIG. 14 is another diagrammatic view of the stator core of FIG. 8, illustrating slot leakage.

As will be explained hereinafter in greater detail, the coils, such as coils 28–31 are separated one from another by a plurality of sections of laminated material configured in large circular laminations such as lamination 37 (FIG. 11) and smaller circular laminations such as a lamination 39 (FIG. 10). The laminated sections when secured together form a series of slots shown generally at 620, including slots 32–35 (FIG. 21) to help concentrate the magnetic flux from each coil and to oriented the flux of each coil in a general horizontal direction as shown diagrammatically in FIGS. 13 and 14.

In order to avoid the possibility of mechanical contact between the coils on the stator 22 and the moving magnets on the mover 20, a magnetic air gap, shown generally at 120 (FIG. 8) is formed between the stator core 94 and the mover 20. The air gap 120 between the stator core 94 and the mover 20 is sufficiently large to permit a thin protective coating (not shown) to be applied to the stator bore to avoid corrosion. In this regard, the distance between the coils on the stator 22 and the magnets on the mover 20 is between about 0.70 mm and about 0.108 mm. A more preferred distance is about 0.80 and about 0.98 mm, and a most preferred distance is about 0.94 mm. The preferred stator bore coating is a good electrical and magnetic insulator that is able to withstand temperatures up to about 125° C.

Considering the motor housing 21 in greater detail with reference to FIGS. 2 and 4–7, the motor housing 21 comprises a pair of spaced-apart housing spacers 60, 62, a pair of spaced-apart end bells 64, 66, and a cable housing 68.

In order to permit the motor assembly 11 to be transported in the small diameter production tubing 15A, the housing spacers 60, 62 and the end bells 64, 66 are generally annularly shaped hollow cylinders adapted to receive within their hollow interiors, the mover 20. The housing spacers 60, 62 and the end bells 64, 66 are coupled together with the cable housing assembly 68 and stator 22 to form the motor housing 21.

As noted earlier, the motor assembly 11 is a nonsalient pole synchronous machine with a large magnetic airgap between the mover 20 and the stator 22. The mover 20 and the stator 22 are constructed to cooperate together to develop a sufficient amount of thrust in a short stroking distance, to effectively and efficiently remove well fluids from downhole to the ground surface. In this regard, the stroking distance is defined along a longitudinal path extending along a path in the cable housing 68, the housing spacers 60, 62, and the end bells 64, 66.

As noted earlier, the motor housing 21 helps define a path of travel for the mover 20. In this regard, the mover 20 travels along the path of travel in a reciprocative manner defining a stroking distance for the mover 20 to actuate the sucker rod pump 13 (FIG. 2). In the preferred embodiment of the present invention, the stroking distance traveled by mover 20 is about 30 feet for developing about 500 pounds of thrust. It will be understood by those skilled in the art, that other stroking distances are possible depending upon the amount of thrust to be developed by the motor 11 and its duty cycle operation. Table I is examples of the thrust per stator sector that may be developed depending on the duty cycle of the motor.

TABLE I

| DUTY CYCLE | THRUST PER SECTOR |
|---|---|
| CONTINUOUS | 25 pounds |
| 66% | 33 pounds |
| 33% | 50 pounds |

Considering now the cable housing assembly 68 in greater detail with reference to FIGS. 2 and 4, the cable housing assembly 68 generally includes a hollow generally conical top portion 71 for helping to guide the cartridge unit 10 in the production tubing 15A and to guide the oil discharge from the pump 13 into the production tubing 15A. The top portion 71 includes an integrally connected generally cylindrical downwardly depending threaded skirt portion 72 (FIG. 4) having a set of threads 73 for threadably connecting the cable housing assembly 68 to the end bell 64. The cable housing assembly 68 also includes a cable terminator shown generally at 74, for attaching the cable 16 to the motor control unit 600.

Considering now the cable terminator 74 in greater detail with reference to FIG. 4, the cable terminator 74 includes a generally conically shaped retainer 84 for engaging an internal taper shoulder 85 converging radially outward from a cable opening to capture the retainer therewithin. The cable 16 passes through the opening and is centrally disposed on the top portion 71 and is connected through the retainer 84 by means (not shown). The motor control unit 600 is disposed directly below the retainer 84 and is supported thereby so that the electrical conductor disposed between the control unit 600 and the motor controller 500 are not stressed when the cartridge unit 10 is raised and lowered in the production tubing 15A.

Considering now the end bells 64 and 66 in greater detail with reference to FIGS. 2, 4 and 5, the end bell 64 is dimensioned for coupling the cable housing 68 to the housing spacer 60. End bell 66 is similarly dimensioned for coupling the housing spacer 62 to the sucker rod pump 13. As end bell 66 is substantially similar to end bell 64 only end bell 64 will be described hereinafter in greater detail.

Considering now the end bell 64 in greater detail with reference to FIGS. 2, 4 and 5, the end bell 64 is generally cylindrically shaped having a pair of threaded wall portions 76 and 77 disposed between an integrally connected annular wall portion 78. The threaded wall portion 76 is adapted to threadably engage the threaded skirt portion 72 of the cable housing 68 for coupling the cable housing 68 to the end bell 64. Similarly, the wall portion 77 is adapted to threadably engage a threaded end portion 52 of the housing spacer 60 for coupling the end ball 64 to the housing spacer 60.

The wall portion 76 includes an annular shoulder 79 which is adapted to matingly engage and support a centrally disposed receiving tube 75. A lower end portion of the tube 75 includes a threaded section that is adapted to threadably engage a set of internal threads 80 disposed on the interior portion of wall 76. As best seen in FIG. 4, the tube 75, extends upwardly from the shoulder 79 and is received within the hollow interior of the cable housing 68. The conductor tube 75 is dimensioned a sufficient width to receive within its interior an upper end portion of the mover 20 so that a constant internal volume is maintained within the interior of the motor 11 The tube 75, thus permits the conductors within the cable 112 to pass through the assembly 68 to the stator 22 without coming into engagement with the mover 20. The annular wall portion 78 also includes an annular interior shoulder 81 for engaging and supporting sealing assembly including a quad ring seal 83 and a cooperating quad ring wiper 85. In this regard the sealing assembly is disposed between the shoulder 81 and the lower terminal end of the tube 75 for helping to prevent lubrication oil within the stator 22 from entering the hollow interior of the cable housing 68.

The wall portion 77 includes a groove 87 that is adapted to engage and support a retaining clip 88 for supporting an annular shaped bearing 90 disposed between the clip 88 and the shoulder 81. The clip 88 has an inner annular opening 89 that is sufficiently large to permit the mover 20 to pass therethrough to permit unimpeded rectilinear movement of the mover 20 through the end bell 64 along its path of travel.

Considering now the housing spacers 60 and 62 in greater detail with reference to FIGS. 4 and 6, the housing spacers 60 and 62 are substantially identical so only housing spacer 60 will be described hereinafter in greater detail.

Considering now the housing spacer 60 in greater detail with reference to FIG. 6, the housing spacer 60 is a hollow elongated cylindrically shaped tube having an annular wall portion 56 having a pair of internally threaded end portions 52 and 54. The threaded end portion 52 is adapted to threadably receive and engage the threaded wall portion 77 of the end bell 64. In a similar manner, as best seen in FIG. 2, the threaded end portion 54 is adapted to threadably receive and engage the stator 22 as will be explained hereinafter in greater detail. An annular shaped position transducer 648 is mounted (by means not shown) within the hollow interior of the housing spacer 60 for sensing the position of the mover 20 as it moves within the spacer 60. A similar position transducer 649 is mounted in housing spacer 62.

Considering now the stator 22 in greater detail with reference to FIGS. 4–11, the stator 22 is generally an elongated hollow cylindrical tube having a central core portion 94 disposed between a pair of spaced apart threaded end portions 92 and 96 respectively. The threaded end portions 92 and 96 include a pair of internally disposed annular grooves 162 and 166 respectively which are adapted to receive and support therein a pair of retaining clips 163 and 167 respectively. As will be explained hereinafter in greater detail, the retaining clips are used to retain a pair of bearings 101 and 103 respectively within the hollow interior of the stator 22 to help enable unimpeded movement of the mover 20 through the stator 22. The threaded end portions 92 and 96 are adapted to be received within and threadably engage the housing spacer 60 and 62 respectively. An annular sheath 98 surrounds the central core 94. As will be explained hereinafter in greater detail the stator core 94 is constructed on a section by section basis and is dimensioned to accommodate a given number of stator core windings, such as at least forty-eight stator core windings. The core windings are divided into the phase groupings 602, 604 and 606. In this regard, the phase grouping 602 includes coil windings with designed locations shown generally at A1, A4, A7, A10, A13, A16, A19, A22, A25, A28, A31, A34, A37, A40, A43, and A46; phase grouping 604 includes coil windings with designated locations shown generally at B3, B6, B9, B12, B15, B18, B21, B24, B27, B30, B33, B36, B39, B42, B45 and B48; and phase grouping 606 include coil windings with designated locations shown generally at C2, C5, C11, C14, C17, C23, C26, C29, C32, C35, C38, C41, C44 and C47.

As best seen in FIG. 21, the designated locations correspond to designated stator core slots locations 1–48. In this regard for example, coil 28 is disposed phase grouping 602 at designated location A28, coil 29 is disposed in phase grouping 606 at designated location C29 and coil 30 is disposed in phase grouping 604 at designated location B30.

As best seen in FIG. 7, the threaded end portion 92 includes an internal bore 93 which terminates in a shoulder 95 defining an opening to an annular bore 104 within the core 94. The bore 104 is dimensioned for receiving the mover 20 therein. The threaded end portion 96 includes a like-dimensioned internal bore 97 which terminates in a shoulder 99 also defining another opening to the bore 104.

In order to help facilitate the unimpeded movement of the actuator 20 within the hollow center of the stator 22, the bearings 101 and 103, are mounted spacéd apart within the stator 22. The bearing 101 is mounted between shoulder 95 and the retaining clips 163, while the bearing 103 is mounted between shoulder 99 and the retaining clip 167.

Considering now the linear motor 11 in still greater detail, given the small inner diameter of the production tubing 15A, a tubular structure is the most appropriate choice for the stator 22. In this regard, in order to maximize utilization of the iron and copper volume, the annularly-shaped electromagnetic stator coils, such as the coils 28–31, are placed in the spaced apart open slots, such as the slots 32–35. The slots 32–35 are disposed along the longitudinal axis of the core 94. Consequently, no end connections of the windings exist, and the entire amount of copper (in the slots) is useful for electromagnetic purposes.

The actuator 20, with its ring-shaped permanent magnets, such as magnets 24–27, mounted thereon, induce motional voltages as the actuator 20 moves within the hollow interior of the stator 22. In this regard, the motional voltages are induced in the 3-phase stator windings and in the stator core 94. Also, hysteresis and eddy-current losses are produced in the core 94. The magnets, such as magnets 24–27 are composed of rare-earth Samarium-Cobalt ($SmCo_5$) and exhibit a demagnetization characteristic as shown by the line 40 in FIG. 22. Such a coordinate axis plot of the characteristics of a magnet are well known.

The hysteresis and eddy-current core losses depend on the core flux density, which is fairly high to reduce the core volume, and the on frequency of the motor 11. In this regard, the on frequency $f_1$ is dependent on the synchronous speed of the motor $u_s$, and the stator winding pole pitch, $\tau$, as defined by equation (1):

$$f_1 = \frac{u_s}{2\tau} \tag{1}$$

In order to reduce the black-iron core height both in the secondary and in the primary (or stator) because of the small external diameter of the stator 22, the pole pitch is reduced to a mechanically feasible minimum value of $\tau = 3$ cm (or 1.18 in). This minimum value is directly dependent upon the internal diameter of the production tube 15A. From equation (1) it follows that such a small pole-pitch will increase the frequency $f_1$ and thereby result in core losses.

The operating frequency, from equation (1) is then given as follows:

$$f_1 = \frac{0.2159}{2(0.03)} = 3.5983 = 3.6 \text{ Hz} \tag{2}$$

The travel time, $t_t$, over the stroke length of a single sector of the motor 11 at a constant speed is given by equation (3):

$$t_t = \frac{\text{stroke length}}{\text{speed}} = \frac{24.5 \text{ inches}}{8.5 \text{ inches/s}} = 2.882 \text{ s} \tag{3}$$

It follows from equations (25) and (26) that the current and the flux in the motor requires approximately $t_1 f1 = 2.882 \times 3.6 = 10.37$ periods over the travel along one sector stroke length.

The low-frequency operation of 3.6 Hz in the motor 11 is a great benefit, as the core losses are low, although the permanent magnet flux density is rather high. In order to reduce core volume, the core flux density is also considerably high. At such a low frequency (of 3.6 Hz) the depth of penetration of the flux in the iron is given by $$\delta_{iron} = \sqrt{(2/\mu_i \omega \sigma_i)} \quad (4)$$
$$= \sqrt{(2/200 \times 4\pi \times 10^{-7} \times 2\pi \times 3.6 \times 5 \times 10^6)}$$
$$= 8.39 \times 10^{-3}\ \text{m} = 8.39\ \text{mm}$$

As will be shown hereinafter later, the slot depth is about 4.5 mm, which compares with $\delta_{iron}$ obtained in equation (27) for a high degree of saturation ($\mu_i$=20-0$\mu_o$). However, to be able to use a stator core, such as the stator core 94, the "apparent" conductivity, $\delta_i$, of the iron must be reduced. To accomplish such a reduction, the core 94 is laminated, so the coils, such as coils 28–31 may be inserted in the slots 32–35, respectively without splitting the stator core 94 into two halves, which would otherwise be required to reduce the core losses. This technique permits the entire core 94 to be built on a tooth-by-tooth basis after inserting the coils, such as the coils 28–31 in the slots of the stator, such as slots 32–35. Such a laminated structure produces low core losses. Moreover, as the laminations are circular or annular in structure, at least in the back-iron leakage fluxes traverse the space between the laminations.

In order to secure the ring shaped laminations forming the core 94 together, a pair of oppositely disposed solid iron lamination holders or rods 114 and 116 (FIG. 11) extend along the entire outer peripheral longitudinal axis of the core 94. The rods 114 and 116 enable the core laminations to be secured together and assembled on a sector by sector basis to form the core 94.

Considering now the mover 20 in greater detail with reference to FIGS. 8–11, the permanent magnets, such as magnets 24–27 mounted on the shaft 23 are interleaved with the low reluctance spacers, such as the spacers 36-39. The magnets, such as magnets 24–27 are coated with a thin coat of high toughness, material shown generally at 122, such as nonmagnetic stainless steel to help reduce mechanical failures of the magnets. A nonmagnetic thin stainless steel sleeve is preferred. A preferred thickness of the sleeve is about 0.1 mm to about 0.2 mm, while a most preferred thickness is about 0.15 mm.

As a single-layer stator winding having 1 slot/pole/phase (q=1) is preferred, a trapezoidal mmf distribution will be produced as a result of the coils being energized with current pulses having a general rectangular shape. Also, because the permanent magnets, such as magnets 24–27 produce (approximately) a trapezoidal airgap flux density, a 120° rectangular current control circuit is necessary to reduce the thrust pulsations. In this regard, where there is an instantaneous commutation, only two of the three phases will be conducting at any given time. FIG. 18 illustrates the ideal rectangular current waveform in each of the three phases, phase a ($P_a$), phase b ($P_b$) and phase c ($P_c$) where only two phases conduct at any given time. The armature mmfs for such a two-phase rectangular current control are shown in FIG. 19, where the mmfs for phases b and c of motor assembly 11 are illustrated generally at 42.

From the foregoing the thrust developed by the motor is given by the following equation:

$$F_x = B_g \times 2 \times 2N_i(\pi D_{si})$$
$$= .6 \times 2\ \ 2N_i\pi \times D_{si}$$

-continued where $D_{si}$ is the stator bore diameter

Assuming a small bore of approximately 29 mm to allow transportation of the motor assembly 11 through the production tube 15A, the total thrust ($F_x$) equals about 0.2194 $N_i$ are determined by choosing a design current density $J_{co}$ at the rms phase current relative to the number of pulse-pairs. In this regard, as the pole-pitch and slot-pitch are known; the phase compare turns can be calculated as follows:

$N_i$=p q nc where p=number of pole-pairs;

q=slots/pole/phase=1; and nc=the number of conductors/slot.

Assuming a gap of 5 slot-pitches (or $S_x$10=50 mm) every 0.48 m (or 16 poles) of stator stack length to install the bearings, the total stator length may be easily calculated by those skilled in the art. A preferred value for $n_c i$ is about $9\times10^{-6}\times7.389\times10^6$ or 66.5 ampere-turns to produce a desire thrust.

From the desired thrust, the overall motor length is determined to be about 10.2 meters for about 154 pole pairs. However, in order to utilize a single Hall-type six-element position transducer, a more preferred number of pole pairs is about 160 distributed over 20 sections where the distance between the first slots of the neighboring sections is as close to 2 T or about 0.06 meters. Thus, surface permanent magnetics have a preferred length of about 25 mm to reduce the thrust pulsations and develop the desired thrust. As the field due to the armature mmf is much lower than the permanent magnet field, the armature mmf will not affect significantly the stator teeth saturation.

Figure 20:
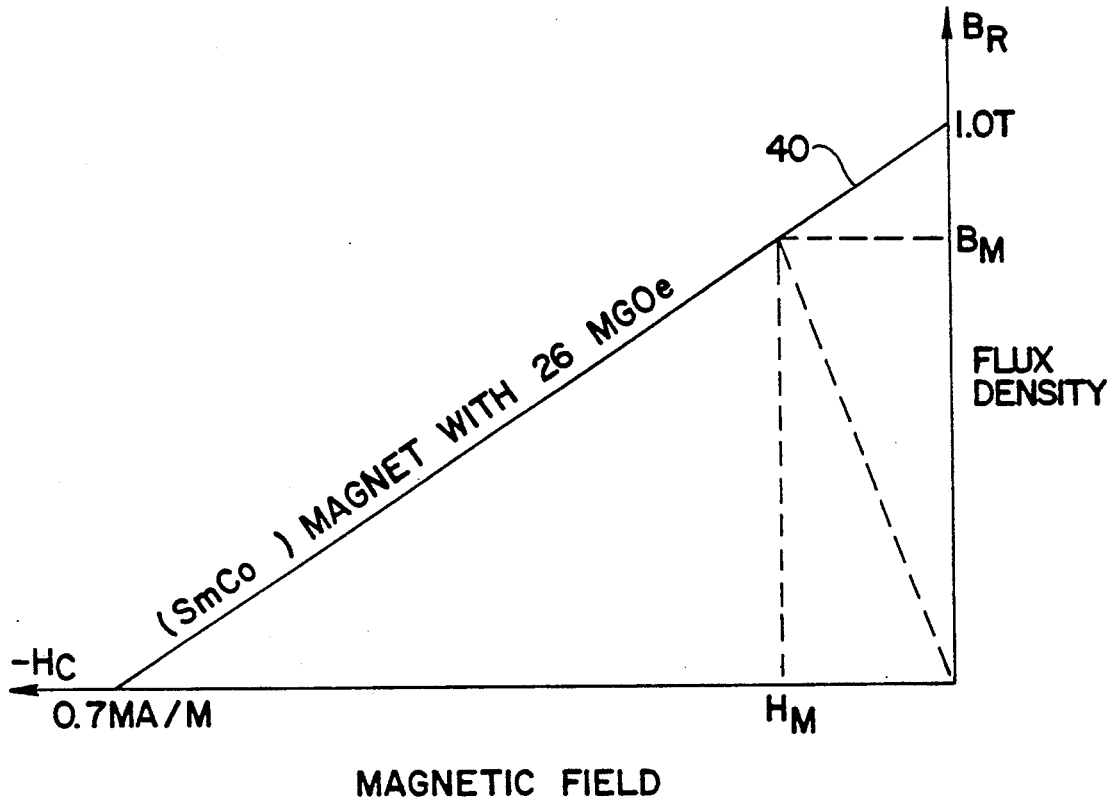
FIG. 20 is a coordinate representation of the demagnetization characteristic of an individual permanent magnet of FIG. 8.

A preferred material for the permanent magnets is Samarium-cobalt (Sm $Co_5$) or a similar type material. For such a magnet $B_r$=1.02 T and $H_e$=0.732 MA/m at 26 MGOe as shown in FIG. 20. With a high $B_{go}$ (close to $B_r$), the thickness of the magnets increases, and thus teeth become thicker and slots thinner to reduce saturation. In such a situation, if the slot depth remains unchanged, the coreback-iron remains fixed for a given stator external diameter. It should be noted however, with a larger airgap, flux density saturation of the stator 22 and the mover core back-irons increase appreciably. Therefore there will be a degradation in the performance of the motor. Therefore to achieve an improved efficiency, the ring height of the permanent magnets is chosen by selecting $B_g$=0.6 T, with $B_r$=1.0 T and $H_c$=0.7 MA/M.

In order to help avoid excessive magnetic saturation and to provide mechanical strength to the actuator 20, the actuator shaft 23 should be composed of a heat tolerant material.

Table I–IV provide respectively the preferred dimensions for the stator core 94, the mover shaft 23, the mover magnets, such as magnets 24–27 and the low reluctance spacers, such as spacers 36–39 for a small diameter motor capable of being mounted within a production tube having an outside diameter of about 2 inches.

TABLE I

| STATOR CORE | |
|---|---|
| length = | 485 mm |
| outer diameter = | 47 mm |
| bore = | 29 mm |
| slot opening = | 5 mm |

TABLE I-continued

| STATOR CORE | |
|---|---|
| slot depth = | 5 mm |
| tooth width = | 5 mm |
| tooth pitch = | 10 mm |
| number of slots = | 48 |
| lamination thickness = | 0.5 mm |
| material: | magnetic steel |

TABLE II

| MOVER CORE | |
|---|---|
| length = | 1400 mm |
| diameter = | 18 mm |
| material: | solid iron |

TABLE III

| MAGNETS | |
|---|---|
| Ring-shaped Samarium-cobalt rare-earth | |
| outer diameter = | 27 mm |
| inner diameter = | 18 mm |
| length = | 25 mm |

Magnets to be coated with a tough non-magnetic conducting 0.1 to 0.2 mm thick-coating (or a 0.1 mm thick stainless steel sleeve over the magnets may be used).

TABLE IV

| SPACERS | |
|---|---|
| low reluctance ring-shaped | |
| length = | 5 mm |
| outer diameter = | 27 mm |
| inner diameter = | 18 mm |

Considering now the surface motor pulse control assembly 500 in greater detail with reference to FIG. 1, the pulse control assembly 500 sends high voltage direct current pulses downhole for use by the motor control unit 600 to control the sequencing of the pulses to the stator winding group 602, 604 and 606. The pulse control assembly 500 is more fully described in copending U.S. patent application 07/462,833.

Considering now the motor control unit 600 in greater detail with reference to FIG. 15, the motor control unit 600 is a rectangular current control on-off controller. As best seen in FIG. 15 the control unit 600 includes a pulse width modulated (PWM) transistor inverter 630 which is coupled to the pulse control assembly 500 via the cable 16. The invertor 630 is a bipositional switch turned on by the signals supplied by the pulse control assembly 600 and has a 5 KHz switching frequency. The invertor 630 includes a power transistor 632 (FIG. 16) and a protective or braking resistor 634. The transistor 632 is a 5 ampere, 1000 volt power transistor.

The control unit 600 also includes a current hysteresis or ramp control unit 635 coupled between the invertor 630 and a six-element per pole pitch position transducer 640 for the commutation of the phases in the invertor 630. The transducer 640 includes a set of six transistor elements 642–647 (T1–T6) to provide a 120° conducting period. The elements of the transducer 640 are shifted to provide three phase commutation and only two transistor elements, such as transistors 642 and 643, conduct at any one time. The transducer 640 also includes a filter capacitor (not shown) and a set of diodes 652–657 that provide a charging path to the charging capacitor.

The position sensor 640 (P) is connected to the individual transistors 642–647 via the hysteresis control unit 635 to provide the positive and negative voltages in the three phases. For example, the position sensors P-T and P-$T_6$ produce, respectively, positive and negative voltages (currents) in a first phase "a"; P-$T_3$ and P-$T_4$ in a second phase "b"; and P-$T_5$ and P-$T_2$ in a third phase "c". Thus, the stator mmf jumps every 60° as best seen in FIG. 18.

The position sensor element (not shown) which energizes transistor 642 ($T_1$) is located 90° behind the axis of phase "a" with respect to the direction of the mover 20 motion. In this regard, the power angle in the motor assembly 17 varies from 60° to 120°, with an average of 90°.

Figure 17:
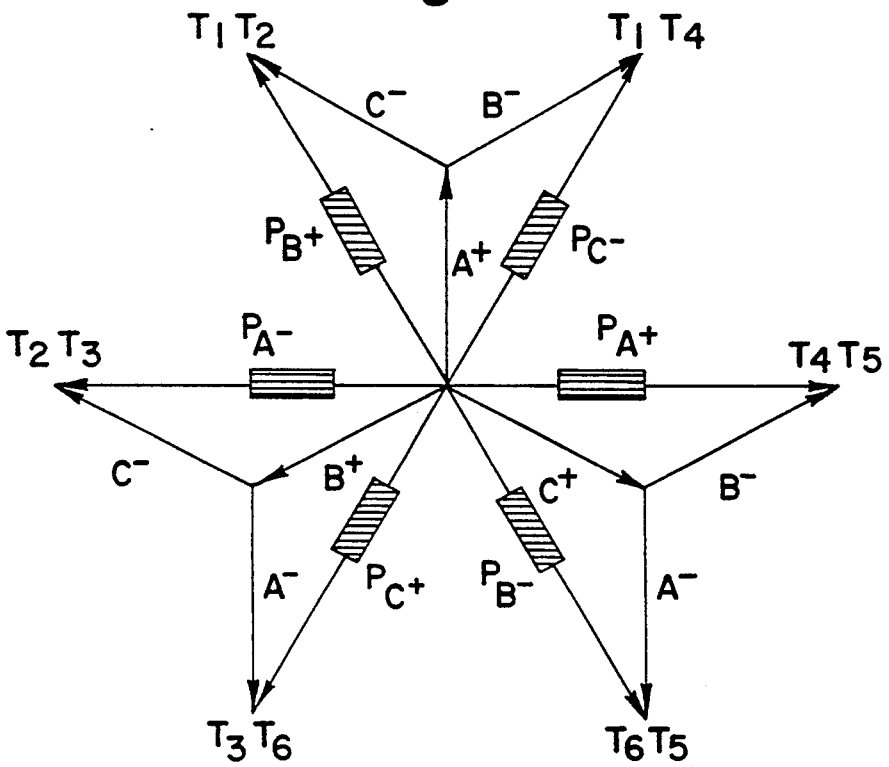
FIG. 17 is a diagrammatic representation of position transducer element locations relative to the stator phases axis of the stator of FIG. 1.

To reverse the direction of the mover 20, the power angle is reversed by 180°. In this regard, the switching of the transistors 642–647 turned on and off by the position transducer 640 is switched by 180°. The command for speed reversal is produced by a proximity transducer having two parts shown generally at 648 and 649 respectively. In this regard, the proximity transducer 648 and 649 generates a signal whenever regenerative braking and speed reversal is to begin. Thus, the output signals change as follows: $a+\rightarrow a-$; $b+\rightarrow b-$; and $c+\rightarrow c-$, and vice versa. FIG. 17 shows diagrammatically the position transducer element locations with respect to stator phase axes.

Figure 16:
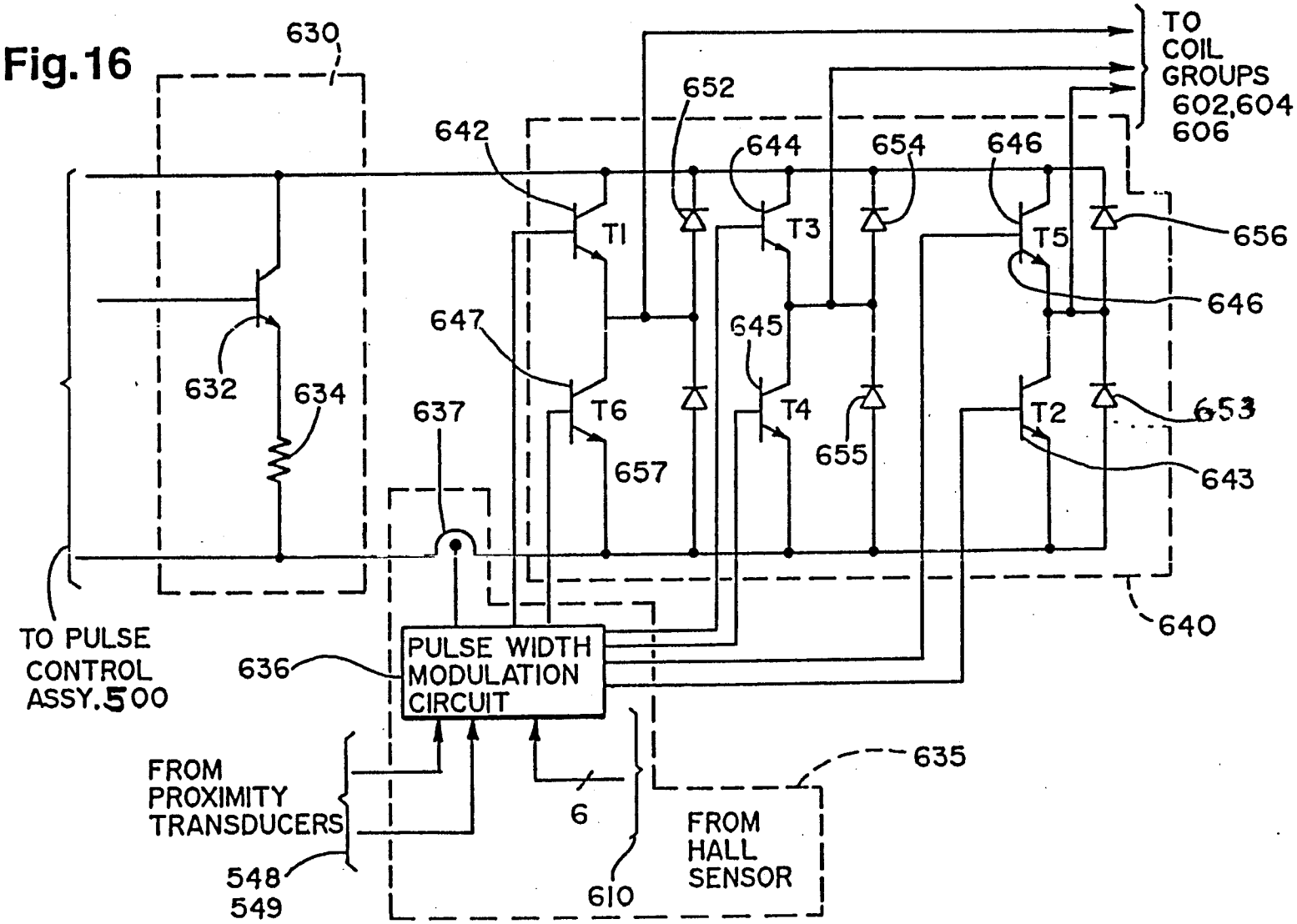
FIG. 16 is a schematic diagram of a pulse width modulated invertor and a hysteresis control unit forming part of the motor control unit of FIG. 1.

Considering now the hysteresis control unit 635 in greater detail with reference to FIG. 16, the hysteresis control unit 635 includes a conventional pulse width modulator circuit 636 and hall type current sensor 637. The hall type current sensor 637 is coupled between the inverter 630 and the position transducer 640 for sensing the flow of current between the inverter 630 and the transducer 640. The pulse width modulation circuit 636 is coupled to the proximity transducers 648 and 649 to change the address of the position sensor 640 by 180° whenever reversing signals are received from the transducer elements 648 and 649.

Figure 3:
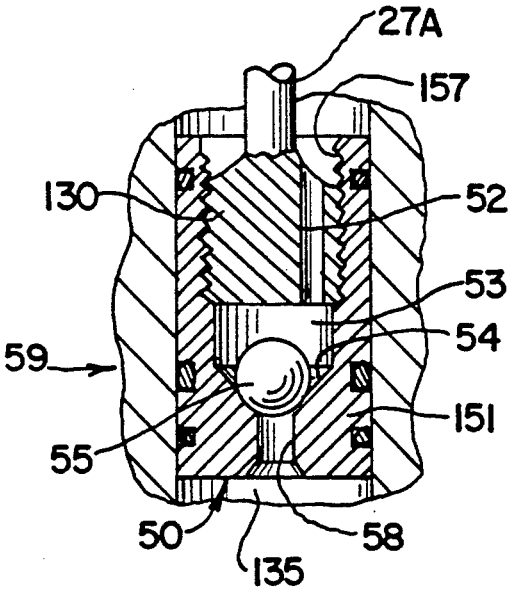
FIG. 3 is a cross section view of the linear d.c. motor mover connecting rod, and the piston pump illustrated in FIG. 2, taken substantially on line 3—3.

Considering now the sucker rod pump 13 in greater detail with reference to FIGS. 1–3, the sucker pump 13 generally comprises a motor assembly engaging portion 42 for helping to couple the motor assembly 11 to the sucker rod pump 13, a lower seat engaging portion, shown generally at 45, for engaging the seal seat 19 of the cartridge sleeve assembly 17 in a fluid tight manner, a pump barrel shown generally at 34, for receiving and pumping the well fluids 12 into the production tubing 15A as will be explained hereinafter in greater detail and a bell section 170 for sealing well fluids from entering the engaging portion 42.

The motor assembly engaging portion 42 is generally a hollow elongated cylindrical member having a pair of threaded end portions, such as an end portion 172. The threaded end portions are adapted to secure together threadably the end bell 66 and the bell section 170. The interior of the engaging portion 42 has a sufficient large internal diameter to accommodate a containment tube extending downwardly from the end bell 66.

Considering now the seat portion 45 in greater detail with reference to FIG. 2, the seat portion 45 includes an upward extending annular neck portion 46 terminating in a lip 47 which defines an opening or mouth to the lower seat portion 45. A set of threads 48 disposed about the inner portion of the neck are adapted to threadably engage the pump barrel 134.

Considering now the pump barrel 134 in greater detail with reference to FIGS. 2, the pump barrel 134 generally includes an upper threaded neck portion 142 for threadably attaching the pump barrel 134 to the motor engaging portion 42 via the bell section 170 and a lower threaded neck portion 64 for threadably attaching the pump barrel 134 to the lower portion 45. The pump barrel 134 also includes a centrally disposed elongated hollow pump chamber 135 disposed between the upper and lower neck portions 142 and 64 respectively for receiving well fluids 12. A pump piston 50 is disposed within the pump chamber 135 for causing the pumping of well fluids into and out of the pumping chamber 135. The chamber portion 35 includes an inlet 36A and a series of radially extending discharge ports, such as port 36B and 36C for passing well fluids through the chamber 135 into a fluid receiving space or channel 21. It should be understood that the annular space 21 is formed between the cartridge unit 10 and the cartridge sleeve assembly 17, for permitting the well fluids 12 within the hollow interior of the sleeve assembly 17 to be passed on the outside of the cartridge unit 10 through the pump, and into the production tubing 15A.

The inlet 36A is centrally disposed within the bottom lower portion 45 and is in fluid communication with the opening 19A so that the well fluid 12, passing through the opening 19A will flow through the inlet 36A into the hollow chamber 35 disposed within the pump barrel 134. The outlet ports, such as port 36B, permit the well fluids 12 within the pumping chamber 135 to be discharged therefrom into the space 21.

Considering now the pump piston 50 in greater detail with reference to FIGS. 2A and 3, the pump piston 50 generally includes a hollow cylinder shaped short stubby body 151 connected to a bottom portion 130 of a piston rod connector 27A for permitting well fluids to pass therethrough. The body 151 includes a centrally disposed internally threaded bore 157 to permit the bottom portion 130 of the piston rod connector 27A to be threadably connected thereto. The bottom portion 130 when coupled to the body 151 helps define an internal fluid receiving chamber 53 within the interior of the pump piston 50.

The bottom portion 130 of the piston rod connector 27A includes an axially extending channel or port 52 that permits fluid within the chamber 53 to pass therethrough and to be discharged by the piston 50 in the chamber 135. The centrally disposed chamber 53 decreases axially progressively towards an annular inlet portion 58. The inlet portion 58 permits well fluids within the chamber 135 below the piston 50 to pass therethrough into chamber 53 and thence the channel 52 to be discharged above the piston 50.

In order to control the flow of well fluids through the piston 50, a check valve shown generally at 59 is disposed between inlet 58 and chamber 53. Valve 59 includes a valve member or ball 55 and a tapered valve seat 54. Check valve 59 allows an upward flow of well fluids into the chamber 53 that prevents down and out flow therefrom. In this regard, as the pump piston 50 travels upwardly it forces the check valve 59 to block inlet 58 so that well fluids above the piston 50 will be discharged from the primary chamber 135 above piston 50 and through the discharge outlets, such as outlet 36B, into the annular space 21.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A linear motor for driving reciprocatively a down hole pump, comprising:

a stator having a very small transverse thickness to axial length ratio, said stator including annular core means defining a plurality of spaced-apart coil receiving slots, and coil means for producing a series of electromagnetic fields extending at least partially in an axial direction when energized with an electric current, said coil means including a plurality of individual annular coils disposed individually within said slots;

mover means for coacting electromagnetically with said coil means and being mounted within said core means; and said mover means including:

(a) an elongated member mounted telescopically reciprocatively within said core means;

(b) a plurality of annularly-shaped permanent magnets mounted on said member in an axially spaced apart manner for generating magnetic fields extending at least partially in an axial direction opposed to the fields produced by said coil means when individual ones of said magnets are disposed opposite corresponding individual ones of said coils to urge said mover to produce relative movement between said stator and said mover;

(c) a plurality of thin annularly-shaped spacers disposed on said member interleaved with said magnets for shunting a portion of said magnetic fields produced by said magnets to reduce substantially core flux losses in said core means.

2. A linear motor according to claim 1, wherein said core means including a plurality of large circular iron lamination sections and a plurality of small circular iron lamination sections; and longitudinal securing means for securing together said plurality of large and small lamination sections to form said plurality of spaced-apart coil receiving slots.

3. A linear motor according to claim 2, wherein said permanent magnets are spaced apart by said spacers a sufficient distance for helping to facilitate phase conduction when individual ones of said coils are electrically energized.

4. A linear motor according to claim 2 wherein said permanent magnets are composed of a rare earth material.

5. A linear motor according to claim 4 wherein said rare earth material is Samarium-Cobalt.

6. A linear motor assembly according to claim 5 wherein individual ones of said magnets are coated with a wear-resistant material.

7. A linear motor assembly according to claim 6, wherein said wear-resistant material is a non-magnetic stainless-steel material.

8. A linear motor assembly according to claim 2 wherein said mover assembly and said stator assembly cooperate together to define a large magnetic airgap of about 0.8 mm.

9. A method of using a linear motor for driving reciprocatively a downhole pump, comprising:

securing removably together a plurality of large circular iron lamination sections and a plurality of small circular iron lamination sections for defining stator core having a plurality of spaced apart transversely disposed coil receiving slots and an axially extending bore;

mounting within each one of said slots an annularly shaped coil;

energizing said coils with rectangular pulses of electrical current for producing a series of electromagnetic fields extending at least partially in an axial direction;

mounting an elongated member telescopically within said bore;

mounting a plurality of annularly-shaped permanent magnets on said elongated member in an axially spaced apart manner to generate a series of magnetic fields extending at least partially in an axial direction opposed to the fields produced by the individual ones of said coils when individual ones of said magnets are in opposition to corresponding individual ones of said coils to urge said rod to produce relative movement along a path of travel defined by said bore; and mounting a plurality of thin annularly-shaped spacer disposed on said elongated member interleaved with said magnets to shunt a portion of said magnetic fields produced by said magnets to reduce substantially core flux losses on said stator core.

10. A system for pumping fluids through a production tube from a downhole well to the ground surface, comprising:

a motor-pump cartridge unit having a pump for pumping the well fluids to the ground surface and a linear motor for driving said pump reciprocatively;

said linear motor including a stator assembly and a mover assembly;

said stator assembly including annular core means defining a plurality of spaced apart coil receiving slots, and coil means for producing a series of electromagnetic fields extending at least partially in an axial direction when energized with an electrical current by said motor controller means;

said coil means including a plurality of individual annular-shaped coils disposed individually within said slots;

said mover assembly including an elongated member mounted telescopically reciprocatively within said core means;

a plurality of annularly-shaped permanent magnets mounted on said member in an axially spaced apart manner for generating magnetic fields extending at least partially in an axial direction opposed to the fields produced by said coil means when individual ones of said magnets are disposed in opposition to corresponding individual ones of said coils to urge said mover assembly to produce relative movement between said stator and said mover; and a plurality of thin annularly-shaped spacers mounted on said member for shunting a portion of said magnetic fields produced by said magnets to reduce substantially core flux losses in said core means; and housing means coupled to said stator assembly for defining a given path of travel for said mover assembly;

said housing means and said stator assembly having a very small transverse thickness to axial length ratio to enable said motor-pump cartridge unit to be received within the production tube for mounting purposes.

11. A system according to claim 10 for pumping fluids from a well including a casing, production tubing disposed therein extending downwardly to a depth at which well fluid is to be pumped from the well further comprising:

motor controller means disposed partially in said motor-pump cartridge unit and partially in a surface control unit disposed spaced apart from said motor-pump cartridge unit and coupled thereto by control cable means for energizing said coil means;

sleeve means attached to the downhole terminal end of the production tubing for admitting well fluids into the production tubing;

said sleeve means being in fluid communication with the production tubing and having a hollow interior with an inlet thereto for admitting well fluids;

said motor-pump cartridge unit being dimensioned to be received and supported within said sleeve means;

said motor-pump cartridge unit further including chamber means for receiving and discharging well fluids, an inlet for admitting well fluids into said chamber means, and an outlet for discharging well fluids from said chamber means into the hollow interior of said sleeve means and thence into the production tubing;

engaging means for coupling detachably said pump cartridge unit to said sleeve means and;

sealing means for coupling detachably the inlet of said sleeve means to the inlet of said pump cartridge unit for admitting well fluids to said chamber means and for helping to prevent well fluids disposed in the production tubing from flowing back into the well.

12. A system according to claim 10, wherein said means defining a plurality of coil receiving slots including a plurality of large circular lamination sections and a plurality of small circular lamination sections; and wherein said stator assembly further includes longitudinal securing means for securing together said plurality of large circular laminations and said plurality of small circular laminations to form said plurality of coil receiving slots.

13. A system according to claim 12, wherein each one of said plurality of permanent magnets is coated with a wear resistant material.

14. A system according to claim 13, wherein said wear resistant material is stainless steel.

15. A system according to claim 14, wherein each one of said permanent magnets are equally spaced apart.

16. A system according to claim 15, wherein said elongated member is a cylindrically-shaped rod.

17. A system according to claim 16, wherein said rod is composed of a heat resistant material.

18. A system according to claim 17, wherein said rod has a diameter of about 18 millimeters.

19. A system for pumping oil well fluids according to claim 18, wherein said control cable means includes a high current cable attached to said motor-pump cartridge unit for mounting the motor-pump cartridge unit within the production tube, said high current cable extending between the ground surface and the motor-pump cartridge unit.

20. A system for pumping oil well fluids according to claim 11, wherein said sleeve means includes a sealing seat for supporting the motor-pump cartridge unit in a stationary position;

said sealing seat cooperating with said motor-pump cartridge unit for establishing a fluid communication path between the production tube and the well fluids through said motor-pump cartridge unit.

21. A system for pumping oil well fluids according to claim 20, wherein said motor-pump cartridge unit includes pumping means for pumping the well fluids through a portion of said motor-pump cartridge unit;

said pumping means including a pumping chamber for receiving a quantity of the well fluids to be pumped from the well, means defining an inlet for establishing fluid communication between said chamber and the fluids to be pumped from the well and for controlling the flow of fluids into and out of said chamber, means defining an outlet for establishing fluid communication between said chamber and the hollow interior of said sleeve assembly, and piston means for moving rectilinearly within said chamber to pump well fluids through said means defining an inlet and said means defining an outlet.

* * * * *